US008403132B2

(12) United States Patent
Moreau et al.

(10) Patent No.: US 8,403,132 B2
(45) Date of Patent: Mar. 26, 2013

(54) RETRACTABLE TOOLING APPARATUS AND TOOL POUCH

(76) Inventors: Darrell A. Moreau, Manchester, NH (US); Andre W. Moreau, Spring Hill, FL (US)

( * ) Notice: Subject to any disclaimer, the term of this patent is extended or adjusted under 35 U.S.C. 154(b) by 0 days.

(21) Appl. No.: 13/075,257

(22) Filed: Mar. 30, 2011

(65) Prior Publication Data

US 2012/0247994 A1 Oct. 4, 2012

(51) Int. Cl.
*B65D 69/00* (2006.01)
*A44B 99/00* (2010.01)

(52) U.S. Cl. ..... 206/234; 24/300; 224/904

(58) Field of Classification Search ..... 206/37, 206/37.1, 38, 38.1, 234, 349–379; 224/904, 224/929–930; 24/299–302
See application file for complete search history.

(56) References Cited

U.S. PATENT DOCUMENTS 2,295,581 A * 9/1942 Hyde ..... 52/114
5,251,743 A * 10/1993 Pulido et al. ..... 206/38.1
5,697,572 A 12/1997 Salentine et al.
5,815,873 A 10/1998 Jones
5,971,101 A * 10/1999 Taggart ..... 206/373
6,427,374 B1 8/2002 Vaiani
6,487,756 B1 12/2002 Vidal, Jr.
6,854,681 B2 2/2005 Kish
7,458,135 B2 * 12/2008 Mikesell et al. ..... 24/300
2006/0261113 A1 * 11/2006 Godshaw et al. ..... 206/349
2007/0215663 A1 * 9/2007 Chongson et al. ..... 224/930

* cited by examiner

*Primary Examiner* — Bryon Gehman
(74) *Attorney, Agent, or Firm* — Robert R. Deleault, Esq; Mesmer & Deleault, PLLC

(57) ABSTRACT

A retractor coil lanyard device for mounting in a pouch of a tool pouch for hand tools includes a tubular housing having a first housing end and a second housing end and a resiliently extensible and retractable coil disposed within the tubular housing. The tubular housing has a predefined length where, when placed within a tool pocket of a tool belt pouch, the first housing end is adjacent a bottom of the tool pocket and the second housing end is adjacent a top of the tool pocket. The coil has a coil body, a first coil end and a second coil end. The coil body is formed from a cord having a predefined diameter where the cord is formed into a helix. The first coil end is retained at the first housing end and the second coil end extends a predefined distance beyond the second housing end and is configured for attaching to a hand tool.

17 Claims, 4 Drawing Sheets

RETRACTABLE TOOLING APPARATUS AND TOOL POUCH

BACKGROUND OF THE INVENTION

1. Field of the Invention

The present invention relates generally to tool pouches and retractable tool lanyards. Particularly, the present invention relates to a tool pouch with a retractable tool lanyard.

2. Description of the Prior Art

The use of hand tools (i.e. hammers, screw drivers, pliers, ratchets, levels, flashlights, tape measures, etc.) when working in overhead situations have the potential to be articles that can cause damage or injury. In these working conditions the hand tools if dropped could cause a hazard to personnel and/or equipment located beneath where the work is being performed.

There are large numbers of conventional tool belts that are used to carry hand tools. These types of tool belts when used in overhead situations will normally include a fastening feature that will lock the specific tool into the tool pouch when it is not being used. When the tool is needed to perform a specific task, the tool pouch is unfastened and the tool is removed from the tool pouch. While in use, if the tool is mishandled, bumped, or jarred, it can become dislodged from the user's hand and free to fall to whatever is beneath the worker. This normally does not pose a hazard except when there are personnel working or even passing by the area located beneath the worker's platform (i.e. when erecting scaffolding, working in elevated situations, etc.).

Another hazardous circumstance can arise when working above vital plant equipment. If a tool is dropped into an area where there is vital equipment, the dropped tool could cause severe damage to the equipment below. There have been many attempts to overcome these hazards with dropped tools. Makeshift lanyards using rope and/or string with duct tape as a fastening means have been used to create wrist lanyards and tethers to keep a specific tool attached to the users arm or wrist.

More elaborate lanyards have also been manufactured for the prevention of dropped tools. One of the simpler models uses webbing with a hook and loop fastener so that it can be adjusted and tightened around the users wrist. With a D-ring sewn into the webbing, one end of a tether can be attached to the wrist lanyard and the other end attached to the tool using one of many available fasteners.

SUMMARY OF THE INVENTION

Although there are more elaborate tooling lanyards available on the market than disclosed above, there is still a high percentage of dropped tools that occur. The disadvantage of the prior art tooling lanyards is due to the inconvenience and cumbersome methods of detaching and reattaching different tools to the lanyards.

It is an object of the present invention to provide a retractable coil lanyard device. It is another object of the present invention to provide a retractable coil lanyard device mountable in a tool pocket of a tool pouch.

The present invention achieves these and other objectives by providing in one embodiment a retractable coil lanyard device that includes a tubular housing having a first housing end and a second housing end and a resiliently extensible and retractable coil disposed within the tubular housing. The tubular housing has a predefined length where, when placed within a tool pocket of a tool pouch, the first housing end is adjacent a bottom of the tool pocket and the second housing end is adjacent a top of the tool pocket. The coil has a coil body, a first coil end and a second coil end. The coil body is formed from a cord having a predefined diameter where the cord is formed into a helix. The first coil end is retained at the first housing end and the second coil end extends a predefined distance beyond the second housing end and is configured for attaching to a hand tool.

In another embodiment of the present invention, the retractable coil lanyard device includes a tool pocket retaining member. The tool pocket retaining member is securely attached adjacent to and extending away from the first housing end of the tubular housing.

In a further embodiment of the present invention, the first coil end of the retractable coil lanyard device has an enlarged end portion. The first housing end of the tubular housing is a closed end having an aperture with a diameter larger than the diameter of the cord diameter of the coil but smaller than the enlarged end portion of the first coil end where the aperture receives the first coil end therethrough.

In another embodiment of the present invention, the first coil end of the retractable coil is rotatably disposed in the aperture of the first housing end.

In still another embodiment of the present invention, the retractable coil lanyard device includes a band fastener disposed around the tubular housing adjacent the first housing end and securely fixing the tool pocket retaining member to the coil housing.

In yet another embodiment of the present invention, the first housing end of the tubular housing has a cap forming the closed end.

In another embodiment of the present invention, the retractable coil lanyard device includes a spacer disposed around the coil at the first coil end between the first housing end and the enlarged end portion of the first coil end.

In another embodiment of the present invention, there is disclosed a tool pouch and retractable lanyard system. The system includes a tool pouch having a plurality of tool pockets and a retractor coil lanyard device. The retractor coil lanyard device has a tubular housing and a helical, resiliently extensible and retractable coil disposed within the tubular housing. A first coil end of the retractable coil is attached to a first housing end and a second coil end extends from a second housing end. The second coil end is configured for attachment to a hand tool. The tubular housing is configured for insertion and retention into one of the plurality of tool pockets.

In a further embodiment of the present invention, there is disclosed a method of making a retractable coil lanyard. The method includes providing a tubular housing having a first housing end and a second housing end, forming a helical, resiliently extensible and retractable coil having a coil body, a first coil end and a second coil end, and disposing the helical coil within the tubular housing and attaching the first coil end to the first housing end. The tubular housing has a predefined length that, when placed within a tool pocket of a tool pouch, the first housing end is adjacent a bottom of the tool pocket and the second housing end is adjacent a top of the tool pocket. The coil body is formed into a helix from a cord having a predefined diameter while the first coil end is configured for attachment to the first housing end and the second coil end configured to extend out of the second housing end and to attach to a hand tool.

DETAILED DESCRIPTION OF THE PREFERRED EMBODIMENT

Figure 1:
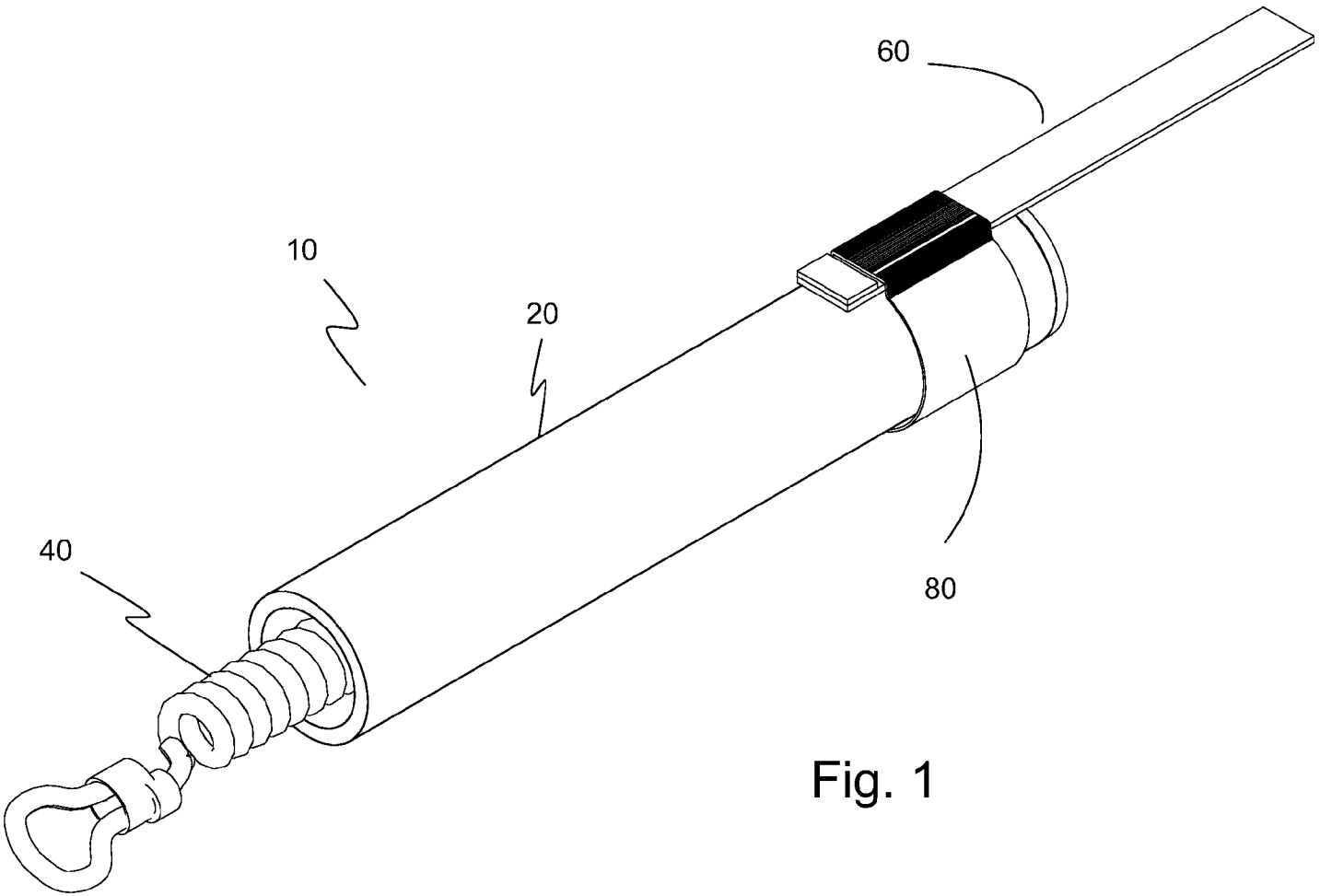
FIG. 1 is a perspective view of one embodiment of the present invention showing a retractor coil device.

The preferred embodiment of the present invention is illustrated in FIGS. 1-9. FIG. 1 is a perspective view illustrating one embodiment of a retractor coil lanyard device 10 of the present invention. Lanyard device 10 has a tubular housing 20, a resiliently extensible and retractable coil 40, a tool pocket retaining member 60, and a band fastener 80. Coil 40 is disposed within tubular housing 20 and is shown in a relaxed, retracted state. As shown in FIG. 1, coil 40 extends out a predefined distance of tubular housing 20.

Figure 2:
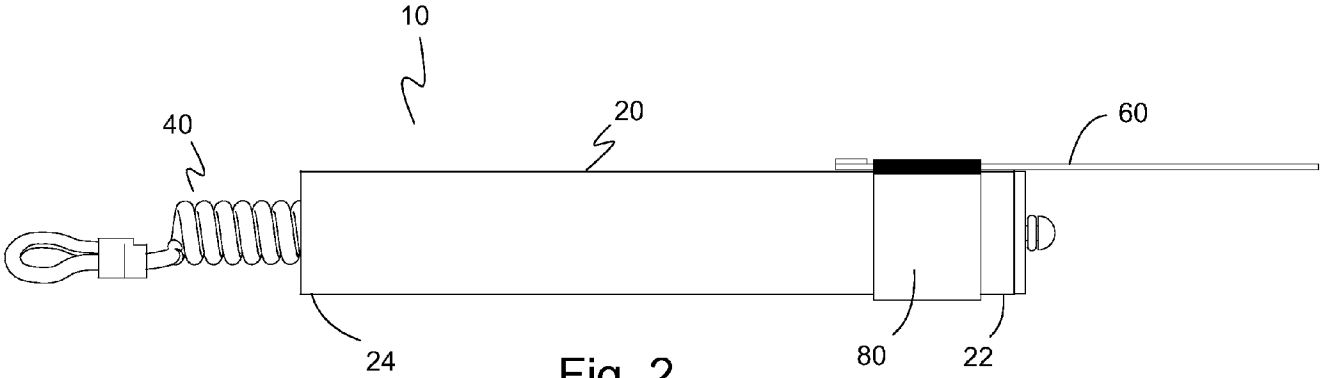
FIG. 2 is a side view of the embodiment of the present invention shown in FIG. 1.

FIG. 2 is a side view of the embodiment shown in FIG. 1. Tubular housing 20 has a first housing end 22 and a second housing end 24. First housing end 22 retains retractable coil 40 to tubular housing 20 while second housing end 24 receives retractable coil 40 therein. Tubular housing 20 is made of a material that is rigid or is sufficiently firm to retain its structural shape as a tubular structure yet may have very limited bendability. Examples of materials that are usable for tubular housing 20 include metals such as aluminum, stainless steel, copper, and the like, and nonmetals such as plastics, carbon fiber, wood, and the like. Preferably, tubular housing is made of a plastic material such as, for example, a thermoplastic or a thermosetting polymer. This includes substances like polyvinyl chloride, polypropylene, polyurethane, polyethylene, polyacetal resins, polytetrafluoethylene, polycarbonate, polyetheretherketone, nylon, and the like.

Figure 3:
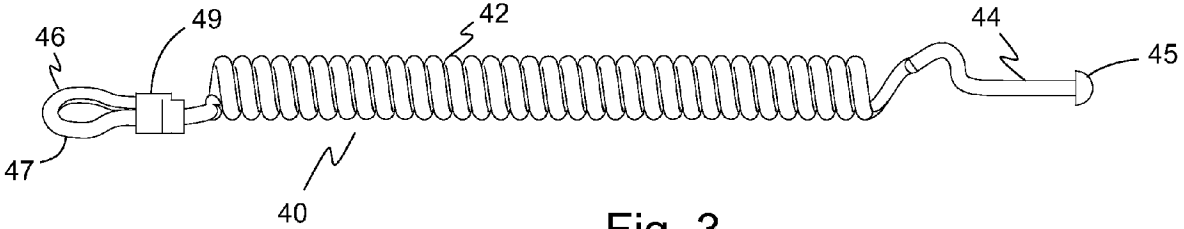
FIG. 3 is a side view of one embodiment of the retractor coil shown in FIG. 2 without the retractor coil housing.

Turning now to FIG. 3, there is shown one embodiment of the retractable coil 40 of the present invention. Retractable coil 40 has a coil body 42, a first coil end 44 and a second coil end 46. Coil body 42 is formed from a cord 43 having a predefined diameter that is formed into the shape of a helix. First coil end 44 is retained at or adjacent first housing end 22, which fixes first coil end 44 relative to housing 20 so that second coil end 46 may be stretched to extend a distance from the retained first coil end 44 substantially close to the length of cord 43 that forms the helix. Second coil end 46 is preferably formed into a loop 47 and secured by a loop fastener 49. Forming second coil end 46 into loop 47 provides a means for connecting adapters such as split rings, snap hooks, and the like, each of which are capable of connecting to a hand tool to be tethered. First coil end 44 has an enlarged end portion 45. Retractable coil 40 may be made of any resilient, spring type material that includes metals and nonmetals. Preferably, the material is a thermoplastic that, when formed into a helical cord, the material provides a spring-type action upon stretching such that the helical cord returns to its original non-stretched state when the stretching action is discontinued. Examples of such thermoplastic material include, for example, polypropylene, polyethylene, polyurethane, and the like. More preferably, retractable coil 40 is made of a polyurethane material.

Figure 4:
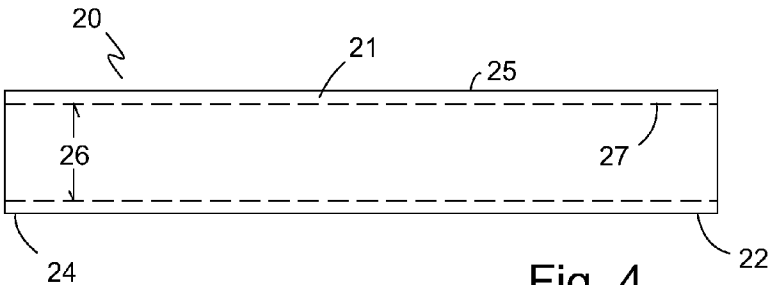
FIG. 4 is a side plan view of one embodiment of the housing with an end cap shown in FIG. 2 without the retractor coil.

FIG. 4 is a side view of tubular housing 20 of the present invention. Tubular housing 20 has a housing body 21, first housing end 22 and second housing end 24. Second housing end 24 is an open end for receiving retractable coil 40. Housing body 21 has an inside dimension 26 that is larger than the outside diameter of coil body 42. The difference between the inside dimension 26 and the outer diameter of coil body 42 is such that the inside surface 27 of tubular housing 20 does not prevent coil body 42 from extending or retracting during use. It is contemplated that the cross-sectional shape of the inside and outside of tubular housing 20 may be any shape but preferably circular, square or rectangular and any inside/outside combination thereof. Although first coil end 22 may be attached or fastened adjacent to first housing end 22 of tubular housing 20 using mechanical methods and devices or adhesives, it is preferred to form first housing end 22 into a closed end.

Figure 5:
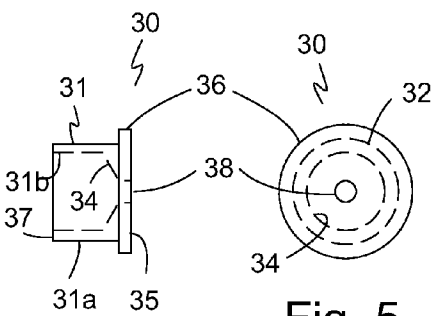
FIG. 5 is an end view of the end cap shown in FIG. 2.

In the preferred embodiment, a cap 30 coupled to first housing end 22 forms the closed end. Cap 30 may either be inserted into or over and around first housing end 22. As illustrated, cap 30 has a cap body 31 and a cap end 35. Cap end 35 has a lateral flange 36 that extends away from cap body 31. Cap body 31 has an outside body surface 31*a* and is sized to have a sliding fit against the inside surface 27 of tubular housing 20 at first housing end 22. Cap body 31 may be secured or removably secured to first housing end 22 such as by threads, adhesives or a friction fit with first housing end 22. A friction fit of cap 30 is preferred because it provides for easier and quicker assembly of cap 30 to tubular housing 20. Cap end 35 has an aperture 38 with a cross-sectional area greater than the cross-sectional area of the cord material used to form retractable coil 20 so that first coil end 44 passes therethrough. It is contemplated that cap 30 may be a solid component with a single longitudinal conduit in cap 30 equal to the size of aperture 38. Alternatively, cap body 31 may have an inside surface 31*b* defining a tubular space with a cross-sectional area that is larger than the cross-sectional area of aperture 38. When circular components are used, this means that the inside diameter of cap body 31 is larger than the diameter of aperture 38. It is preferred to have the latter design so that a friction fit may be more easily attained since a thinner wall 37 in cap body 31 provides some limited flexibility against the inside surface of first housing end 22. This alleviates the need to have very exacting friction fit dimensions for joining cap 30 to first housing end 22. It is also preferred to have a tapered surface 34 between the inside surface 31*b* and aperture 38. FIG. 5 illustrates an end view of cap 30 showing aperture 38.

Figure 6:
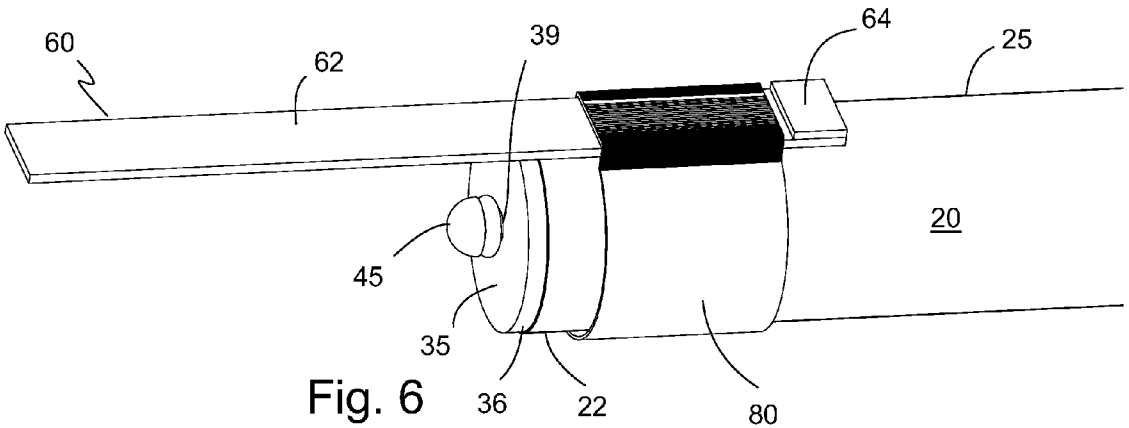
FIG. 6 is an enlarged, partial perspective view of the end cap end of the embodiment shown in FIG. 1 showing a pouch securing tab.

Turning now to FIG. 6, there is illustrated an enlarged, perspective view of first housing end 22 of retractor coil lanyard device 10 shown in FIG. 1. As illustrated, cap 30 is connected to first housing end 22 of tubular housing 20 where cap flange 36 abuts first housing end 22. First coil end 44 is positioned within aperture 38 of cap end 35 such that enlarged end portion 45 is outside of tubular housing 20. Enlarge end portion 45 spatially retains first coil end 44 at first housing end 22, which allows retractable coil 20 to extend and retract relative to tubular housing 20. Optionally and preferably, first coil end 44 is not fixedly attached to cap end 35 but freely rotates within aperture 38. Allowing retractable coil 20 to freely rotate relative to tubular housing 20 minimizes unwanted twisting of retractable coil 20 as a tool that is attached to second coil end 46 is used and manipulated. Tool pocket retaining member 60 is coupled to first housing end 22 and extends longitudinally away from first housing end 22 and housing 20. Tool pocket retaining member 60 is preferably made of a flexible material such as, for example, a piece of webbing. In the preferred embodiment, band fastener 80 is a sleeve made of shrink tubing that couples retaining member 60 to the outer surface 25 of tubular housing 20. Retaining member 60 has a first retaining member body 62 and a first retaining member end 64 that is thicker and/or larger than member body 62. By making member end 64 larger and by positioning band fastener 80 around member body 62 and tubular housing 20 such that band fastener 80 is between member end 64 and cap end 35, retaining member 60 may be securely fastened to a tool pocket and member end 64 will prevent inadvertent slipping removal of retractor coil lanyard device 10 from the tool pocket. The larger member end 64 will not be able to slip between band fastener 80 and outer surface 25 of tubular housing 20.

Figure 8:
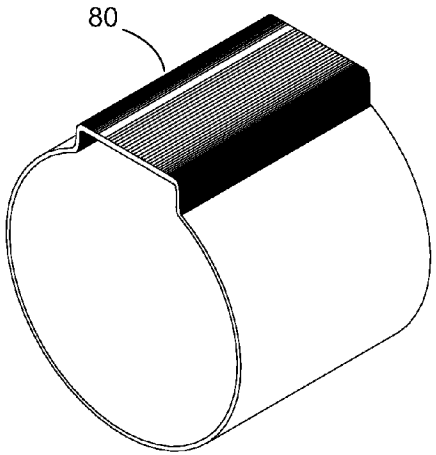
FIG. 8 is an enlarged, perspective view of the tab securing band.
Figure 7:
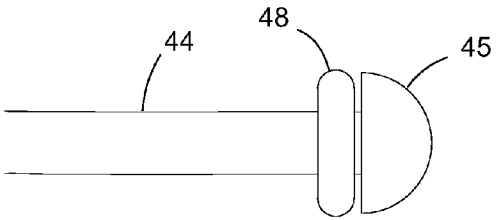
FIG. 7 is an enlarged, partial side view of one end of the retractor coil showing the housing securing end.

FIG. 7 is an enlarged partial view of first coil end 44. First coil end 44 has enlarged end portion 45 such that enlarged end portion 45 cannot be pulled through aperture 38 in cap 30 under normal use. Enlarged end portion 45 may be any type of mechanical component fastened to first coil end 44 or may be formed from first coil end 44. In the latter case, end portion 45 may be formed in various ways. For example, first coil end 44 may be tied into a knot provided that the cord material is sufficiently flexible to allow this type of manipulation. Another example would be to "melt" or "soften" first coil end 44 to form enlarged end portion 45 especially when the cord material is a thermoplastic material. Optionally, a spacer component 48 may be positioned between enlarged end portion 45 and cap end 35. Spacer component 48 may be an O-ring or have a washer shape made of thermoplastic material, rubber or metal. Optional spacer component 48 further ensures free rotation of retractable coil 20 at first housing end 22 by further minimizing any potential binding between enlarged end portion 45 and cap end 35 especially when retractable coil 20 is in an extended position, which necessarily imparts a larger force of enlarged end portion 45 against cap end 35. FIG. 8 is a perspective view of band fastener 80. It is contemplated that other means of fastening tool pocket retaining member 60 to tubular housing 20 may be used. Examples of such means include adhesives, rivets, screws, slots and/or openings in tubular housing 20 to fix and hold first coil end 44 to tubular housing 20.

Figure 9:
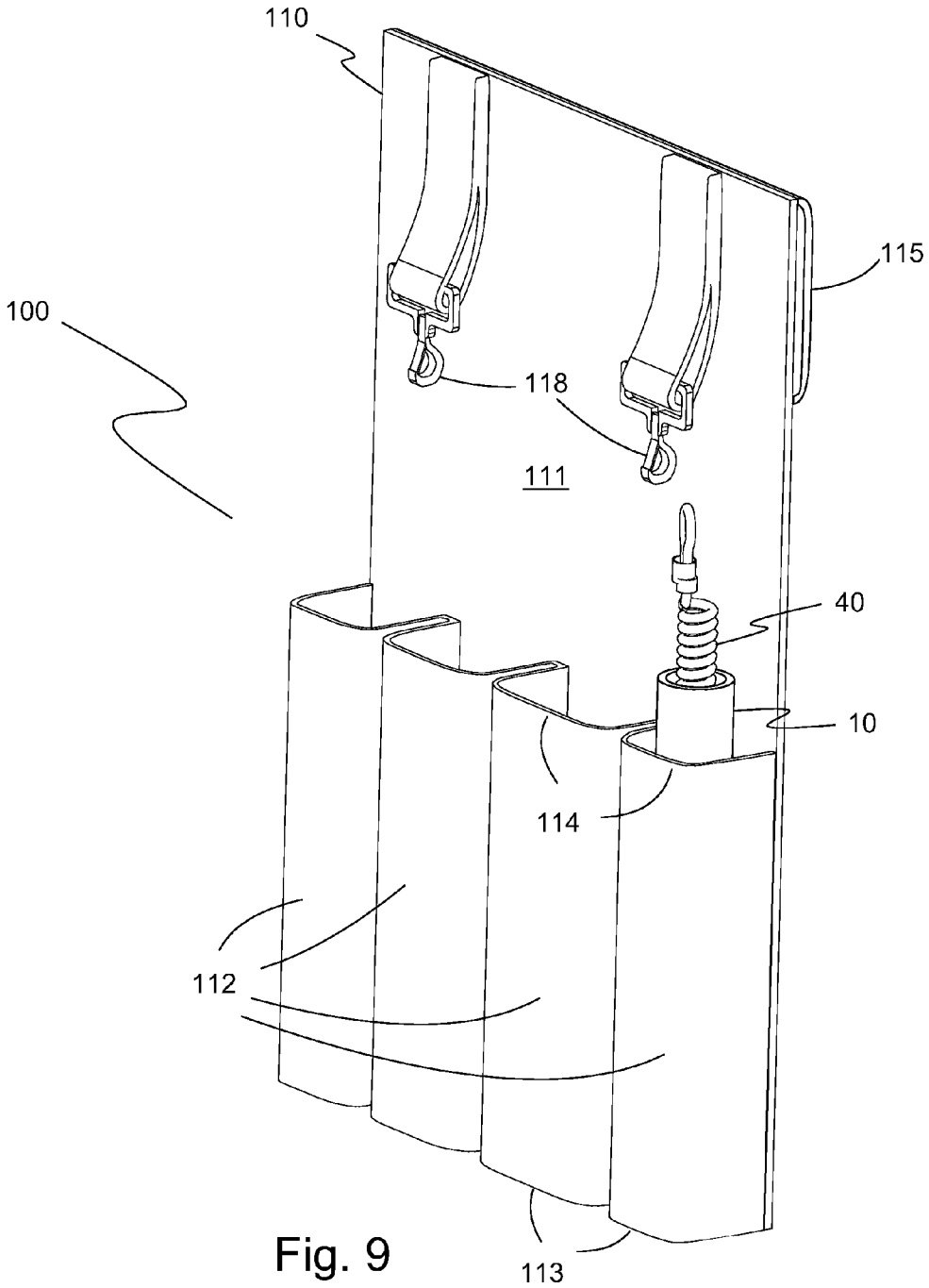
FIG. 9 is a perspective view of a tool pouch showing a tool receptacle containing a retractable tool lanyard device shown in FIG. 1.

Turning now to FIG. 9, there is illustrated tool retractor system 100 of the present invention. Tool retractor system 100 includes a tool pouch 110 and a retractor coil lanyard device 10. Tool pouch 110 has a plurality of tool pockets 112 sized to accommodate a variety of hand tools (not shown) or a retractor coil lanyard device 10. As shown, one of the plurality of tool pockets 112 contains retractor coil lanyard device 10. Tool pouch retainer member 60 (not shown) is fixedly attached at or near a pocket bottom 113 to hold retractor coil lanyard device 20 in tool pocket 112. Tool pouch 110 also includes a belt retaining component 115 that receives a tool belt (not shown) for securing around a user. Tool pouch 110 has an upper panel 111. Upper panel 111 optionally has a tool clip member 116 coupled thereto. Tool clip member 116 is fastened to upper panel 111 and preferably has a spring clip 118 installed on tool clip member 116. Spring clip 118 is engageable with a hand tool (not shown) to prevent accidental release of the hand tool from the tool pocket. The hand tool typically has a split ring or other opening about which spring clip 118 may attach.

Making the retractor coil lanyard device 10 will not be described. A tubular housing 20 is provided that has a predefined length. The length is selected so that, when placed within a tool pocket 112 of a tool pouch 110, a first housing end 22 is adjacent the pocket bottom 113 and a second housing end 24 is adjacent a pocket top 114 of tool pocket 112. A resiliently extensible and retractable coil 40 is formed to have a coil body 42, a first coil end 44 and a second coil end 46. Coil body 42 is formed into a helix from a cord having a predefined diameter. The material and diameter of the cord is selected based on a predefined tensile strength and predefined elasticity of the cord material as well as the weight of the predefined hand tool to which retractable coil 40 is to be attached.

When cap 30 is used to form first housing end 22 into a closed end, first coil end 44 is inserted into cap body 31 and out through aperture 38 of cap end 35. After inserting first coil end 44 through aperture 38, the enlarged end portion 45 is formed so that coil end 44 cannot be pulled back through aperture 38 under normal use. If an optional spacer 48 is used, then spacer 48 is disposed onto first coil end 44 after first coil end 44 is passed through aperture 38 and before enlarged end portion 45 is formed. Second coil end 46 of coil body 42 is inserted into tubular housing 40 at first housing end 22 until cap 35 is adjacent first housing end 22. Cap 35 is then either fixedly attached to or force fitted into first housing end 22. At this point, second coil end 46 and a portion of coil body 42 is extending out of second housing end 24. Second coil end 46 is then formed into a loop 47 and secured to itself using loop fastener 49.

Optional tool pocket retaining member 60 is formed having a retaining member body 62 and a retaining member end 64. When retaining member 60 is made of a web material, retaining member end 64 is most easily made by doubling a portion of retaining member end 64 onto itself and then fastening the doubled portion by stitching or using adhesives or both. Retaining member 60 is placed against housing outer surface 25 at first housing end 22 and band fastener 80 is slipped onto first housing end 22 so that a portion of retaining member 60 adjacent retaining member end 64 is between housing outer surface 25 and band fastener 80. When shrink tubing is used as the material for band fastener 80, the tubing is then heat-shrunk around tubular housing 10 capturing retaining member 60 against tubular housing 10.

When tubular housing 10 is formed to have a closed end with aperture 38 as a unitary structure, then first coil end 44 is inserted into second housing end 24 until first coil end 44 exits aperture 38 at first housing end 22. The remaining steps described above are then performed.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A retractor coil lanyard device for mounting in a pouch of a tool pouch for hand tools, the retractor coil device comprising:

a tubular housing having a first housing end and a second housing end, the tubular housing having a predefined length wherein when placed within a tool pocket of a tool belt pouch the first housing end is adjacent a bottom of the tool pocket and the second housing end is adjacent a top of the tool pocket; and a resiliently extensible and retractable coil disposed within the tubular housing, the coil having a coil body formed from a cord having a predefined diameter wherein the cord is formed into a helix, a first coil end and a second coil end wherein the first coil end has an enlarged end portion and the first housing end is a closed end having an aperture with a diameter larger than the diameter of the cord diameter of the coil but smaller than the enlarged end portion wherein the aperture receives the first coil end therethrough and the second coil end extends a predefined distance beyond the second housing end and configured for attaching to a hand tool.

2. The device of claim 1 further comprising a tool pocket retaining member securely attached adjacent to and extending away from the first housing end of the tubular housing.

3. The device of claim 2 further comprising a tool pouch having a plurality of tool pockets configured to receive the tubular housing of the retractor coil lanyard device and configured to secure the tool pocket restraining member to the tool pouch.

4. The device of claim 2 further comprising a band fastener disposed around the tubular housing adjacent the first housing end and securely fixing the tool pocket retaining member to the tubular housing.

5. The device of claim 1 wherein the second coil end forms a closed loop.

6. The device of claim 1 wherein the first coil end is rotatably disposed in the aperture.

7. The device of claim 1 further comprising a cap having a cap end with an aperture therethrough disposed at the first housing end forming a closed end.

8. The device of claim 1 further comprising a spacer disposed around the first coil end between the first housing end and the enlarged end portion of the first coil end.

9. A method of making a retractable coil lanyard for use with a tool pouch, the method comprising:

providing a tubular housing having a first housing end and a second housing end, the tubular housing having a predefined length wherein when placed within a tool pocket of a tool pouch the first housing end is adjacent a pocket bottom of the tool pocket and the second housing end is adjacent a pocket top of the tool pocket;

forming the first housing end into a closed end with an aperture therethrough;

forming a helical, resiliently extensible and retractable coil, the coil having a first coil end, a second coil end and a coil body formed into a helix from a cord having a predefined diameter, the first coil end configured for attachment to the first housing end and the second coil end configured to extend out of the second housing end and to attach to a hand tool; and disposing the helical coil within the tubular housing, inserting the first coil end through the aperture of the first housing housing end, and forming an enlarged end portion at the first coil end.

10. The method of claim 9 further comprising sliding a spacer member onto the first coil end after the first coil end is inserted through the aperture and before the enlarged end portion is formed at the first coil end.

11. A tool pouch and retractable lanyard system comprising:

a tool pouch having a plurality of tool pockets; and a retractor coil lanyard device having a tubular housing and a helical, resiliently extensible and retractable coil disposed within the tubular housing wherein a first coil end has an enlarged end portion and the first housing end is a closed end having an aperture with a diameter larger than the diameter of the cord diameter of the coil but smaller than the enlarged end portion wherein the aperture receives the first coil end therethrough and a second coil end extends from a second housing end, the second coil end being configured for attachment to a hand tool, the tubular housing being configured for insertion and retention into one of the plurality of tool pockets.

12. The system of claim 11 wherein the retractor coil lanyard device further includes a tool pocket retaining member securely attached adjacent to and extending away from the first housing end of the tubular housing.

13. The system of claim 12 further comprising a band fastener disposed around the tubular housing adjacent the first housing end and securely fixing the tool pocket retaining member to the tubular housing.

14. The system of claim 11 wherein the second coil end forms a closed loop.

15. The system of claim 11 wherein the first coil end is rotatably disposed in the aperture.

16. The system of claim 11 wherein the first housing end has a cap disposed at the fist housing end forming the closed end.

17. The system of claim 11 further comprising a spacer disposed around the coil at the first coil end between the first housing end and the enlarged end portion of the first coil end.

* * * * *